US009780492B1

(12) United States Patent
Wang et al.

(10) Patent No.: US 9,780,492 B1
(45) **Date of Patent: *Oct. 3, 2017**

(54) STRUCTURE OF ELECTRICAL CONNECTOR

(71) Applicant: Allsmartlite Technology Co., Ltd., Shenzhen (CN)

(72) Inventors: Xiaoping Wang, Shenzhen (CN); Ming-Han Perng, Shenzhen (CN); Chien-Hsing Lai, Shenzhen (CN)

(73) Assignee: ALLSMARTLITE TECHNOLOGY CO., LTD., Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/263,381

(22) Filed: Sep. 13, 2016

(51) Int. Cl.

| | |
|---|---|
| ***H01R 13/6471*** | (2011.01) |
| ***H01R 24/60*** | (2011.01) |
| ***H01R 13/6581*** | (2011.01) |
| ***H01R 13/42*** | (2006.01) |
| *H01R 107/00* | (2006.01) |

(52) U.S. Cl.
CPC ..... *H01R 13/6471* (2013.01); *H01R 13/42* (2013.01); *H01R 13/6581* (2013.01); *H01R 24/60* (2013.01); *H01R 2107/00* (2013.01)

(58) Field of Classification Search
CPC H01R 13/6471; H01R 13/42; H01R 13/6581; H01R 24/60
USPC ..... 439/607.01, 607.32, 607.4, 108
See application file for complete search history.

(56) References Cited

U.S. PATENT DOCUMENTS

| | | | | |
|---|---|---|---|---|
| 7,771,238 | B2 * | 8/2010 | Aoki | G06K 19/07732 235/441 |
| 7,918,673 | B1 * | 4/2011 | Mimura | H01R 13/6471 439/101 |
| 8,277,253 | B2 * | 10/2012 | Lee | H01R 12/724 439/540.1 |
| 8,393,920 | B2 * | 3/2013 | Yu | H01R 13/6461 439/660 |
| 8,398,438 | B2 * | 3/2013 | Zhang | H01R 13/6471 439/660 |
| 8,672,711 | B2 * | 3/2014 | Kondo | H01R 12/57 439/607.1 |
| 8,747,149 | B2 * | 6/2014 | Wu | H01R 13/658 439/108 |
| 8,801,462 | B2 * | 8/2014 | Tsai | H01R 12/724 439/607.01 |
| 9,142,926 | B2 * | 9/2015 | Tsai | H01R 24/60 |

(Continued)

*Primary Examiner* — Alexander Gilman
(74) *Attorney, Agent, or Firm* — Leong C. Lei

(57) ABSTRACT

Disclosed is an improved structure of an electrical connector, which includes an upper transmission conductor assembly including an upper grounding terminal assembly and an upper power terminal assembly; and a lower transmission conductor assembly including a lower grounding terminal assembly and a lower power terminal assembly, each of which defines soldering sections, extension sections, and contact sections. The soldering sections have a width between 0.35 mm and 0.45 mm and a thickness between 0.1 mm and 0.2 mm. The extension sections have a width between 0.35 mm and 0.45 mm and a thickness between 0.1 mm and 0.2 mm. The contact sections have a width between 0.285 mm and 0.295 mm and a thickness between 0.1 mm and 0.2 mm. As such, a need for supply of a large electrical current can be satisfied and noise interference can be prevented.

7 Claims, 6 Drawing Sheets

(56) References Cited

U.S. PATENT DOCUMENTS

| | | | | |
|---|---|---|---|---|
| 9,203,176 | B2 * | 12/2015 | Dong | H01R 13/516 |
| 9,231,356 | B1 * | 1/2016 | Ju | H01R 24/78 |
| 9,318,853 | B2 * | 4/2016 | Little | H01R 13/6658 |
| 9,350,126 | B2 * | 5/2016 | Little | H01R 24/60 |
| 9,356,400 | B2 * | 5/2016 | Little | H01R 4/023 |
| 9,478,916 | B2 * | 10/2016 | Kao | H01R 13/6593 |
| 9,478,923 | B2 * | 10/2016 | Kao | H01R 24/60 |
| 9,525,227 | B2 * | 12/2016 | Little | H01R 13/6273 |
| 2013/0063908 | A1 * | 3/2013 | Lee | H01R 13/405 361/752 |
| 2014/0370729 | A1 * | 12/2014 | Wang | H01R 13/6471 439/108 |
| 2015/0162714 | A1 * | 6/2015 | Yu | H01R 24/62 439/660 |
| 2015/0171573 | A1 * | 6/2015 | Little | H01R 24/60 439/607.34 |
| 2016/0294121 | A1 * | 10/2016 | Daughtry, Jr. | H01R 13/405 |
| 2016/0378632 | A1 * | 12/2016 | Srivastava | G06F 11/3051 714/5.1 |
| 2017/0085038 | A1 * | 3/2017 | Duan | H01R 24/64 |

* cited by examiner

STRUCTURE OF ELECTRICAL CONNECTOR

TECHNICAL FIELD OF THE INVENTION

The present invention relates generally to an improved structure of an electrical connector, which suits the need for supply of a large electrical current and also eliminates noise interference.

DESCRIPTION OF THE PRIOR ART

A conventional high-speed connector comprises metal conductors that are arranged to be very close, spatially, to each other so that capacitive coupling would occur during the transmission of signals and thus increasing interference with the transmission of the signals and lowering stability of signal transmission. In addition, impedance matching is necessary between a high-speed transmission interface and a system main board interface, otherwise signal reflection would occur, leading to loss, deformation, and distortion of electronic signals, eventually making bandwidth and quality of electronic signals not reaching desired levels.

Further, recently, portable electronic products have been demanding increased amounts of power consumption. However, the conventional high-frequency connector bears electrical current loading that has been long kept at a fixed level, leading to insufficient supply of electrical power or slow transmission of electrical power.

SUMMARY OF THE INVENTION

An object of the present invention is to increase widths and thicknesses of grounding terminals and power terminals to predetermined values in order to satisfy the need for a large electrical current while preventing noise interference.

To achieve the above object, the present invention comprises a shielding enclosure. The shielding enclosure receives at least one insulation assembly arranged therein. The insulation assembly comprises an upper transmission conductor assembly mounted thereto. The upper transmission conductor assembly comprises an upper grounding terminal assembly and an upper power terminal assembly arranged in the upper grounding terminal assembly. The insulation assembly is provided, at one side thereof that is opposite to the upper transmission conductor assembly, with a lower transmission conductor assembly. The lower transmission conductor assembly comprises a lower grounding terminal assembly and a lower power terminal assembly arranged in the lower grounding terminal assembly.

The upper grounding terminal assembly, the upper power terminal assembly, the lower grounding terminal assembly, and the lower power terminal assembly comprise soldering sections defined at one end thereof, each of the soldering sections having a width between 0.35 mm and 0.45 mm and a thickness between 0.1 mm and 0.2 mm, an extension sections defined at one side of each of the soldering sections, each of the extension sections having a width between 0.35 mm and 0.45 mm and a thickness between 0.1 mm and 0.2 mm, and a contact section defined at one side of each of the extension sections that is opposite to each of the soldering sections, each of the contact sections having a width between 0.285 mm and 0.295 mm and a thickness between 0.1 mm and 0.2 mm. Consequently, the volume or size of each grounding terminal assembly and power terminal assembly is increased to increase electrical current loading capacity thereof for suiting the need for supply of a large electrical current and reducing noise interference. As such, the drawbacks of the conventional high-frequency connectors that the electrical current loading capacity is insufficient and noise interference is severe can be overcome to achieve the advantages of suiting the need of supply of large electrical current and preventing noise interference.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
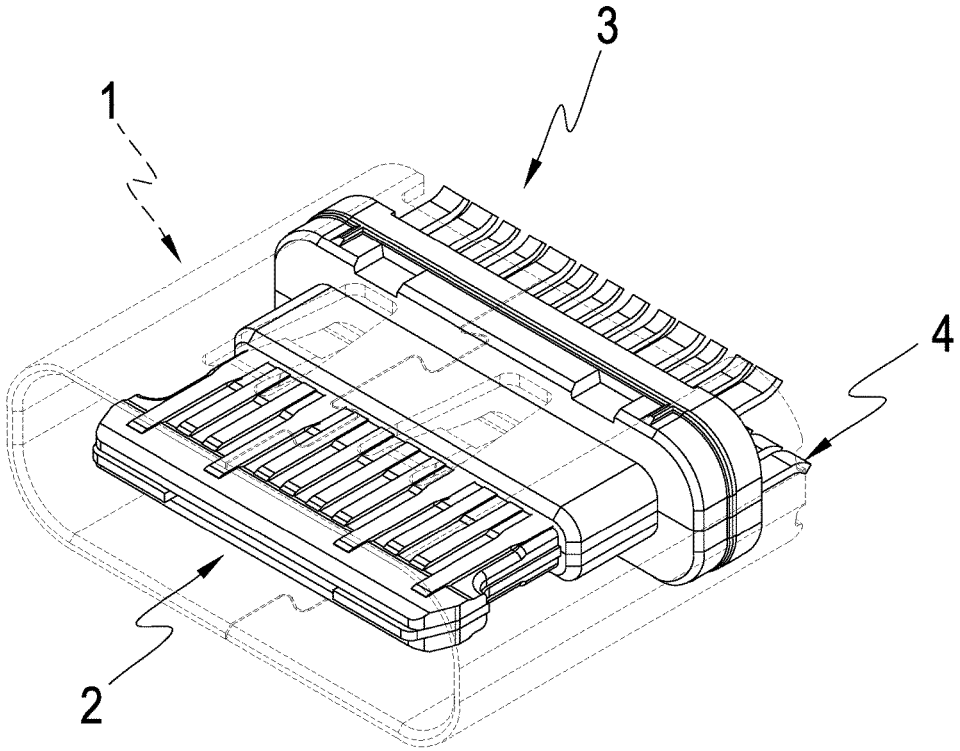
FIG. 1 is a perspective view of the present invention.
Figure 2:
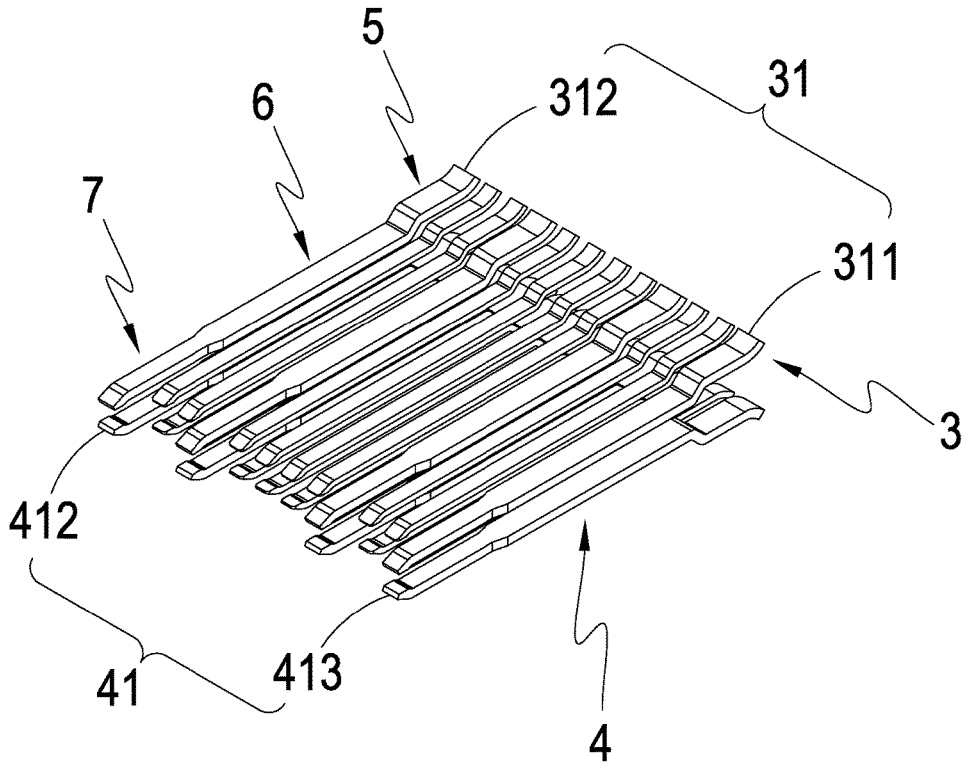
FIG. 2 is a perspective view showing transmission conductors of the present invention.
Figure 3:
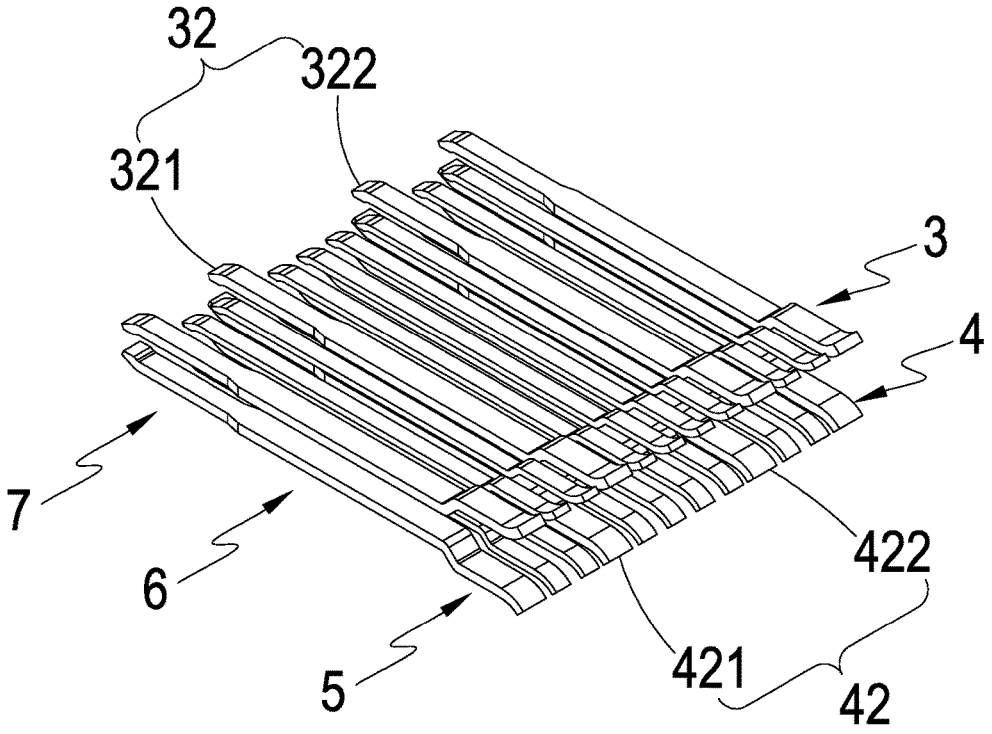
FIG. 3 is a perspective view showing the transmission conductors of the present invention.
Figure 4:
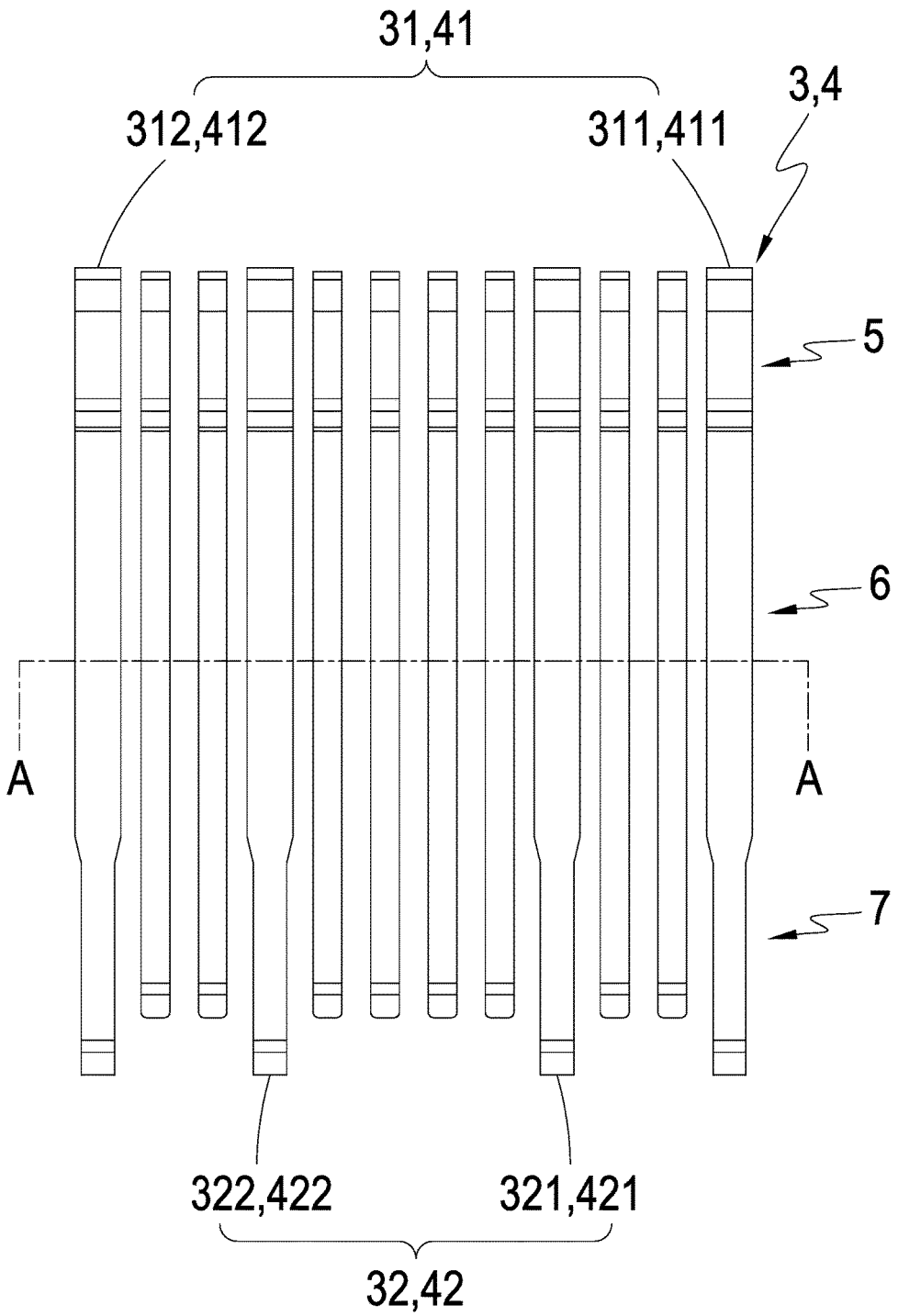
FIG. 4 is a top plan view showing the transmission conductors of the present invention.
Figure 5:
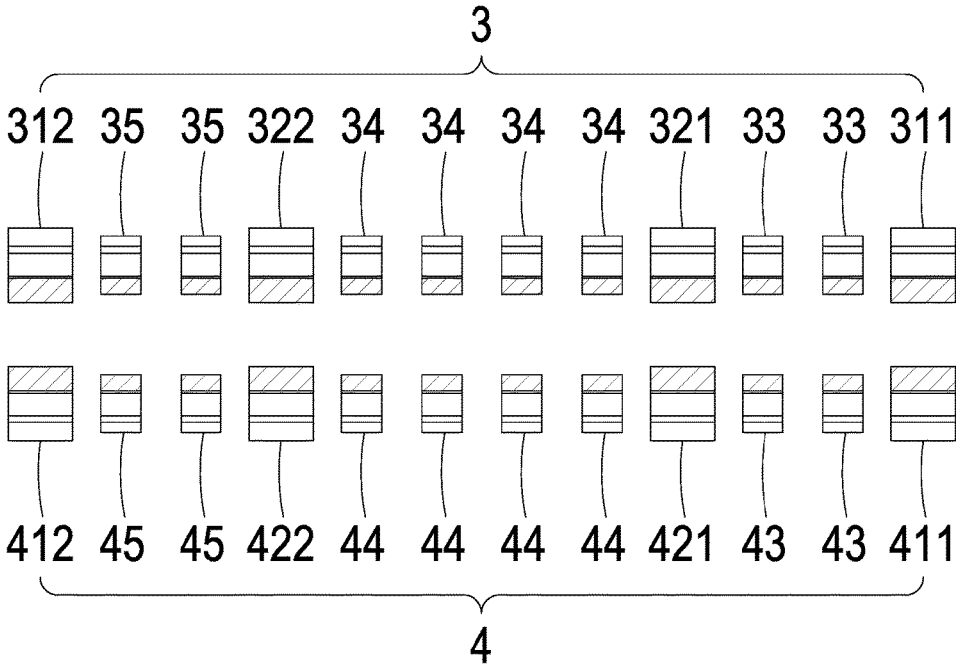
FIG. 5 is a cross-sectional view of the present invention, taken along line A-A of FIG. 4.

Referring to FIGS. 1-5, an embodiment of an electrical connector is shown, which as shown for illustration and explanation, is a female connector that meets the specification of Universal Serial Bus (USB) 3.1 Type-C.

The present invention generally comprises a shielding enclosure 1, at least one insulation assembly 2, an upper transmission conductor assembly 3, and a lower transmission conductor assembly 4. The insulation assembly 2 is arranged inside the shielding enclosure 1. The upper transmission conductor assembly 3 is mounted on the insulation assembly 2. The upper transmission conductor assembly 3 comprises an upper grounding terminal assembly 31 and an upper power terminal assembly 32 arranged in the upper grounding terminal assembly 31. The lower transmission conductor assembly 4 is mounted to the insulation assembly 2 at one side thereof that is opposite to the upper transmission conductor assembly 3 and comprises a lower grounding terminal assembly 41, and a lower power terminal assembly 42 arranged in the lower grounding terminal assembly 41.

The upper grounding terminal assembly 31, the upper power terminal assembly 32, the lower grounding terminal assembly 41, and the lower power terminal assembly 42 define, at one end thereof, soldering sections 5. Each of the soldering sections has a width between 0.35 mm and 0.45 mm, a preferable width being 0.4 mm. Each of the soldering sections has a thickness between 0.1 mm and 0.2 mm, a preferable thickness being 0.15 mm.

The upper grounding terminal assembly 31, the upper power terminal assembly 32, the lower grounding terminal assembly 41, and the lower power terminal assembly 42 are provided with extension sections 6. Each of the extension sections 6 is located at one side of each of the soldering sections 5. Each of the extension sections 6 has a width between 0.35 mm and 0.45 mm, a preferable width being 0.4 mm. Each of the extension sections 6 has a thickness between 0.1 mm and 0.2 mm, a preferable thickness being 0.15 mm.

The upper grounding terminal assembly 31, the upper power terminal assembly 32, the lower grounding terminal assembly 41, and the lower power terminal assembly 42 are provided with contact sections 7. Each of the contact sections 7 is located at one side of each of the extension sections 6 that is opposite to each of the soldering sections 5. Each of the contact sections 7 has a width between 0.285 mm and 0.295 mm, a preferable width being 0.29 mm. Each of the contact sections 7 has a thickness between 0.1 mm and 0.2 mm, a preferable thickness being 0.15 mm.

The upper grounding terminal assembly 31 comprises a first upper grounding terminal 311 and a second upper grounding terminal 312 arranged at one side of the first upper grounding terminal 311. The upper power terminal assembly 32 comprises a first upper power terminal 321 and a second upper power terminal 322 arranged at one side of the first upper power terminal 321. In addition, the upper transmission conductor assembly 3 further comprises a first upper differential signal terminal assembly 33 arranged between the first upper grounding terminal 311 and the first upper power terminal 321, an upper signal terminal assembly 34 arranged between the first upper power terminal 321 and the second upper power terminal 322, and a second upper differential signal terminal assembly 35 arranged between the second upper power terminal 322 and the second upper grounding terminal 312. The first upper differential signal terminal assembly 33, the upper signal terminal assembly 34, and the second upper differential signal terminal assembly 35 have a width and a thickness that are smaller than the upper grounding terminal assembly 31 and the upper power terminal assembly 32.

The lower grounding terminal assembly 41 comprises a first lower grounding terminal 411 and a second lower grounding terminal 412 arranged at one side of the first lower grounding terminal 411. The lower power terminal assembly 42 comprises a first lower power terminal 421 and a second lower power terminal 422 arranged at one side of the lower power terminal. In addition, the lower transmission conductor assembly 4 further comprises a first lower differential signal terminal assembly 43 arranged between the first lower grounding terminal 411 and the first lower power terminal 421, a lower signal terminal assembly 44 arranged between the first lower power terminal 421 and the second lower power terminal 422, and a second lower differential signal terminal assembly 45 arranged between the second lower power terminal 422 and the second lower grounding terminal 412. The first lower differential signal terminal assembly 43, the lower signal terminal assembly 44, and the second lower differential signal terminal assembly 45 have a width and a thickness that are smaller than the lower grounding terminal assembly 41 and the lower power terminal assembly 42.

Accordingly, the upper transmission conductor assembly 3 comprises terminals of which a sequence of arrangement is the first upper grounding terminal 311, the first upper differential signal terminal assembly 33 (2 pins), the first upper power terminal 321, the upper signal terminal assembly 34 (4 pins), the second upper power terminal 322, the second upper differential signal terminal assembly 35 (2 pins), and the second upper grounding terminal 312; and the lower transmission conductor assembly 4 comprises terminals of which a sequence of arrangement is the first lower grounding terminal 411, the first lower differential signal terminal assembly 43 (2 pins), the first lower power terminal 421, the lower signal terminal assembly 44 (4 pins), the second lower power terminal 422, the second lower differential signal terminal assembly 45 (2 pins), and the second lower grounding terminal 412.

Figure 6:
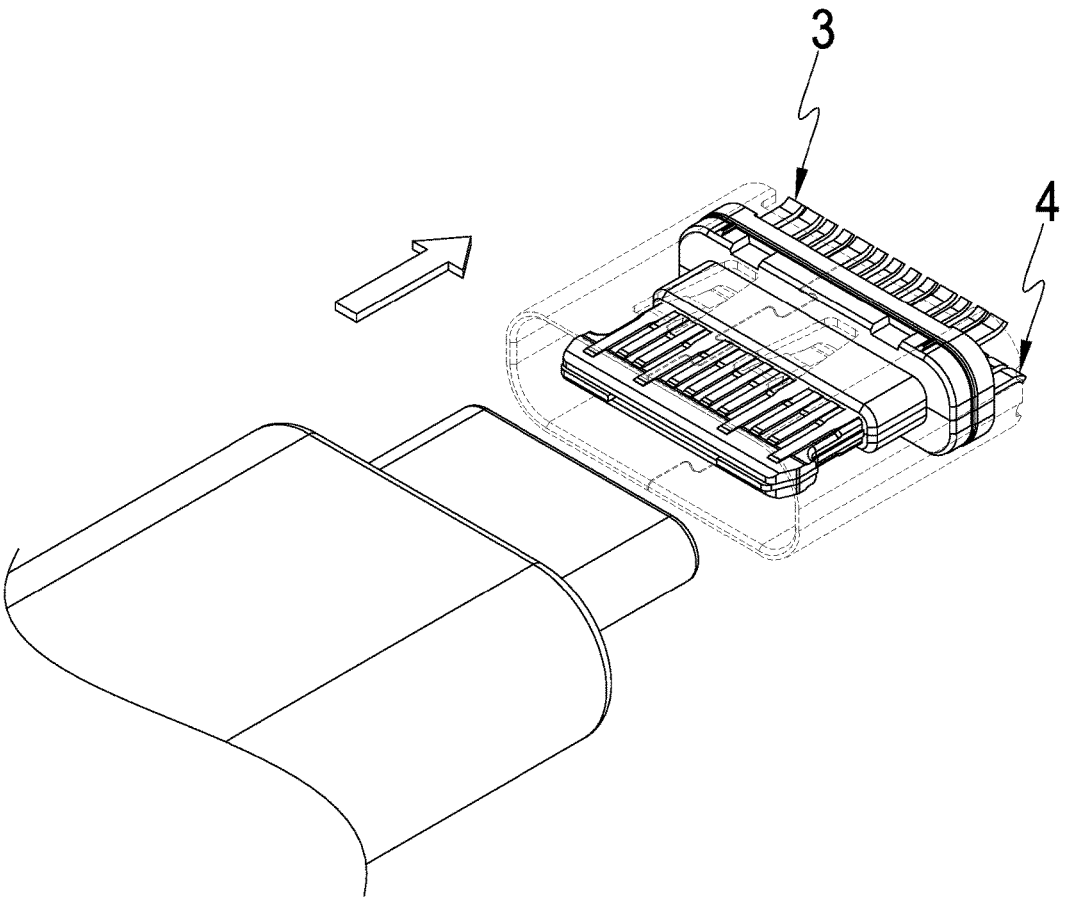
FIG. 6 is a schematic view illustrating a use of the present invention.

Referring to FIGS. 1-6, to use, the present invention is insertable and thus connectable with a male connector and the sequence of arrangement of the terminals of the upper transmission conductor assembly 3 is the first upper grounding terminal 311, the first upper differential signal terminal assembly 33, the first upper power terminal 321, the upper signal terminal assembly 34, the second upper power terminal 322, the second upper differential signal terminal assembly 35, and the second upper grounding terminal 312, while the sequence of arrangement of the terminals of the lower transmission conductor assembly 4 is the first lower grounding terminal 411, the first lower differential signal terminal assembly 43, the first lower power terminal 421, the lower signal terminal assembly 44, the second lower power terminal 422, the second lower differential signal terminal assembly 45, and the second lower grounding terminal 412, so that contact and engagement can be made with transmission conductors of the male connector, wherein the present invention is arranged such that the upper grounding terminal assembly 31 (including the first upper grounding terminal 311 and the second upper grounding terminal 312), the upper power terminal assembly 32 (including the first upper power terminal 321 and the second upper power terminal 322), the lower grounding terminal assembly 41 (including the first lower grounding terminal 411 and the second lower grounding terminal 412), and the lower power terminal assembly 42 (including the first lower power terminal 421 and the second lower power terminal 422) are structured to have the widths and thicknesses thereof increased and thus, each of the soldering sections 5, each of the extension sections 6, and each of the contact sections 7 is provided with an increased volume or size to effectively increase electrical current loading capacity of the upper grounding terminal assembly 31, the upper power terminal assembly 32, the lower grounding terminal assembly 41, and the lower power terminal assembly 42 for suiting a user's need for supply of a large electrical current and preventing increase of nose interference.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

We claim:

1. An electrical connector structure, comprising:

a shielding enclosure;

at least one insulation assembly, which is arranged inside the shielding enclosure;

an upper transmission conductor assembly, which is mounted to the insulation assembly and comprises an upper grounding terminal assembly and an upper power terminal assembly arranged in the upper grounding terminal assembly;

a lower transmission conductor assembly, which is mounted to the insulation assembly at one side opposite to the upper transmission conductor assembly and comprises a lower grounding terminal assembly and a lower power terminal assembly arranged in the lower grounding terminal assembly;

a plurality of soldering sections, each of which is defined at an end of the upper grounding terminal assembly, the upper power terminal assembly, the lower grounding terminal assembly, and the lower power terminal assembly, each of the soldering sections having a width between 0.35 mm and 0.45 mm, each of the soldering sections having a thickness between 0.1 mm and 0.2 mm;

a plurality of extension sections, each of which is defined on the upper grounding terminal assembly, the upper power terminal assembly, the lower grounding terminal assembly, and the lower power terminal assembly and located at one side of each of the soldering sections, each of the extension sections having a width between 0.35 mm and 0.45 mm, each of the extension sections having a thickness between 0.1 mm and 0.2 mm; and a plurality of contact sections, each of which is defined on the upper grounding terminal assembly, the upper power terminal assembly, the lower grounding terminal assembly, and the lower power terminal assembly and located at one side of each of the extension sections that is opposite to each of the soldering sections, each of the contact sections having a width between 0.285 mm and 0.295 mm, each of the contact sections having a thickness between 0.1 mm and 0.2 mm;

wherein the upper grounding terminal assembly comprises a first upper grounding terminal and a second upper grounding terminal arranged at one side of the first upper grounding terminal; the upper power terminal assembly comprises a first upper power terminal and a second upper power terminal arranged at one side of the first upper power terminal; the lower grounding terminal assembly comprises a first lower grounding terminal and a second lower grounding terminal arranged at one side of the first lower grounding terminal; and the lower power terminal assembly comprises a first lower power terminal and a second lower power terminal arranged at one side of the lower power terminal;

wherein the upper transmission conductor assembly further comprises a first upper differential signal terminal assembly arranged between the first upper grounding terminal and the first upper power terminal, an upper signal terminal assembly arranged between the first upper power terminal and the second upper power terminal, and a second upper differential signal terminal assembly arranged between the second upper power terminal and the second upper grounding terminal, and the first upper differential signal terminal assembly, the upper signal terminal assembly, and the second upper differential signal terminal assembly have a width and a thickness that are smaller than the upper grounding terminal assembly and the upper power terminal assembly; and wherein the lower transmission conductor assembly further comprises a first lower differential signal terminal assembly arranged between the first lower grounding terminal and the first lower power terminal, a lower signal terminal assembly arranged between the first lower power terminal and the second lower power terminal, and a second lower differential signal terminal assembly arranged between the second lower power terminal and the second lower grounding terminal, and the first lower differential signal terminal assembly, the lower signal terminal assembly, and the second lower differential signal terminal assembly have a width and a thickness that are smaller than the lower grounding terminal assembly, and the lower power terminal assembly.

2. The electrical connector structure according to claim 1, wherein each of the soldering sections has a preferred width of 0.4 mm and a preferred thickness of 0.15 mm.

3. The electrical connector structure according to claim 1, wherein each of the extension sections has a preferred width of 0.4 mm and a preferred thickness of 0.15 mm.

4. The electrical connector structure according to claim 1, wherein each of the contact sections has a preferred width of 0.29 mm and a preferred thickness of 0.15 mm.

5. The electrical connector structure according to claim 1, wherein the electrical connector is a female connector.

6. The electrical connector structure according to claim 1, wherein the electrical connector satisfies specification of Universal Serial Bus (USB) 3.1.

7. The electrical connector structure according to claim 1, wherein the electrical connector satisfies specification of Universal Serial Bus (USB) Type-C.

* * * * *